US007494112B2

(12) United States Patent
Fromm

(10) Patent No.: US 7,494,112 B2
(45) Date of Patent: Feb. 24, 2009

(54) RAPID DEPLOYMENT BARRIER AND METHOD OF USING THE SAME

(76) Inventor: Jeffrey Earl Fromm, 130 E. Sunbury St., Shamokin, PA (US) 17872

( * ) Notice: Subject to any disclaimer, the term of this patent is extended or adjusted under 35 U.S.C. 154(b) by 150 days.

(21) Appl. No.: 11/372,908

(22) Filed: Mar. 10, 2006

(65) Prior Publication Data

US 2007/0272911 A1 Nov. 29, 2007

Related U.S. Application Data

(60) Provisional application No. 60/674,477, filed on Apr. 25, 2005.

(51) Int. Cl.
*E04H 17/14* (2006.01)
*E01F 13/00* (2006.01)

(52) U.S. Cl. ..... 256/64; 404/6

(58) Field of Classification Search ..... 256/13.1, 256/30, 31, 64; 404/6, 9
See application file for complete search history.

(56) References Cited

U.S. PATENT DOCUMENTS 1,449,518 A * 3/1923 Lawson ..... 404/6
3,065,680 A * 11/1962 Wiedman, Sr. ..... 404/6
5,145,278 A 9/1992 Lohrmann
5,228,237 A * 7/1993 Nasatka ..... 404/6
5,356,119 A * 10/1994 Schock ..... 256/31
5,443,324 A 8/1995 Sullivan
5,685,665 A 11/1997 Lembo
6,200,063 B1 3/2001 Fritzinger
6,296,234 B1 * 10/2001 De Boer ..... 256/64
D462,126 S 8/2002 Englund
6,679,649 B1 1/2004 Capolupo
6,702,512 B1 * 3/2004 Reale ..... 404/6
6,840,706 B1 1/2005 Camomilla
6,962,245 B2 * 11/2005 Ray et al. ..... 404/10
7,172,176 B1 * 2/2007 Eastland ..... 256/31
2004/0028469 A1 2/2004 Dehart
2004/0057790 A1 3/2004 Tagg
2004/0146345 A1 7/2004 Consolazio
2005/0201629 A1 9/2005 Debart
2005/0254892 A1 11/2005 Yodock

* cited by examiner

*Primary Examiner*—Victor MacArthur
(74) *Attorney, Agent, or Firm*—Brian Belles

(57) ABSTRACT

A barrier device capable of rapid deployment and assembly to form a barrier wall. The barrier device comprises slidable interlock capabilities so that adjacent barriers can be connected to one another quickly and without the use of any tools or other components. In one aspect, the invention is the barrier device comprising: a base plate having a bottom surface and a top surface; and a wall plate connected to and extending upward from the top surface of the first plate, the wall plate comprising a first lateral edge and a second lateral edge. The wall plate of any one barrier device can slidably mate with a second lateral edge of the wall plate of an adjacent barrier device.

15 Claims, 12 Drawing Sheets

RAPID DEPLOYMENT BARRIER AND METHOD OF USING THE SAME

CROSS-REFERENCE TO RELATED APPLICATIONS

The present application claims the benefit of U.S. Provisional Patent Application 60/674,477, filed Apr. 25, 2005, the entirety of which is hereby incorporated by reference.

FIELD OF THE INVENTION

The present invention relates generally to the field of portable barriers, and specifically to portable barriers capable of rapid deployment for protecting against vehicular and military style attacks.

BACKGROUND OF THE INVENTION

A barrier device is a structure that is designed to prohibit people, vehicles or other machinery from entering a protected space. The need for barrier devices has increased over the years, especially in view of the increased threat of terrorist attacks on civilian, military and government targets both in the United States and abroad. Moreover, as the technical capabilities, quality of equipment and potency of bombs and other explosive devices employed by terrorists and/or insurgents has increased, so has the need to maintain a more secure, stable, robust and/or larger perimeter around our troops and/or target structures.

A variety of devices have been developed to absorb the kinetic energy generated by the impact of a colliding vehicle. One such structure is the highway barrier. Highway barriers are designed to provide a continuous wall or barrier along the center line of a highway when laid end-to-end to absorb grazing blows from moving vehicles. One commonly used highway barrier is formed of pre-cast reinforced concrete, and is known as the "New Jersey" style barrier. Highway barriers of this type have a relatively wide base including side walls which extend vertically upwardly from the pavement a short distance, then angle inwardly and upwardly to a vertically extending top portion connected to the top wall of the barrier. This design is intended to contact and redirect the wheels of a vehicle in a direction toward the lane of traffic in which the vehicle was originally traveling, instead of the lane of opposing traffic. An example of such a highway barrier is disclosed in U.S. Pat. No. 4,059,362, issued Nov. 22, 1977. Highway barriers, however, are not specifically designed to absorb a head-on collision from a vehicle or to successfully withstand an explosive attack. Moreover, because highway barriers have a typical weight of about 2,800-3,200 pounds and require special equipment to load, unload and handle, highway barriers are incapable of being rapidly deployed to form a protective perimeter in a short amount of time. Finally, because highway barriers are constructed of concrete, high barriers will shatter and create dangerous debris during an impact event. Thus, the typical highway barrier does not serve as an adequate shield for personnel because the debris from the highway barrier is equivalent to shrapnel.

While a number of barrier devices have been specifically developed to maintain a safe distance between our troops (and/or target structures) and any suicide bombers either walking or operating a vehicle, existing barrier devices are less than optimal. Existing barrier devices are either: (1) not strong enough; (2) difficult or time consuming to set up; (3) easy to by-pass or destroy; and and/or (4) inadequate in preserving an acceptable perimeter.

An example of an existing barrier device is disclosed in U.S. Design Patent 500,859 ("Dehat"), issued Jan. 11, 2005. The Dehart barrier is an assembly of several steel plates stood upright in an opposing orientation and connected to each other by two long poles/rods. The Dehart barrier suffers from a variety of disadvantages. First, the Dehart barrier is a solid unitary structure that is heavy, cumbersome, time consuming and difficult to handle and deploy. As a result, heavy equipment, such as cranes, lifts, or the like are necessary to handle and deploy the Dehart barrier. Second, the Dehart barrier offers little to no protection to people or structures on one side of the barrier from debris, gunfire or other shrapnel that may result from a vehicle or other attack on the opposite side of the barrier. Third, the Dehart barrier device contains no means by which it can be easily connected and secured to another Dehart barrier device or structure to increase the protected perimeter in a stable and robust arrangement.

A second barrier device that exits has been built by Lawrence Livermore of the National Laboratory at the University of California. The Livermore barrier is made for military checkpoints and is a long pipe-like device connected by an ordinary steel cable. The steel cable is secured at each of its end to a separate vehicle which pull the ends of the cable in opposite directions, thereby removing slack from the cable. While the Livermore barrier may be able to stop a terrorist bomber, it does not appear to be capable of deployment in short notice. Moreover, the Livermore barrier suffers from many of the drawbacks set forth above with respect to the Dehart barrier.

Finally, because the Livermore barrier requires that the cable be taut in order to properly work, at least one soldier must be located in each vehicle (at opposite ends of the cable) in order to make the barrier work. Therefore, you have at least two soldiers exposed to the terrorist vehicle. Additionally, a soldier inspecting a suspect vehicle is still in danger because he/she must be in front of the Livermore barrier.

Thus, a need exists for a more stable, rapidly deployable, robust, and improved barrier system, apparatus, and method.

DISCLOSURE OF THE INVENTION

It is therefore an object of the present invention to provide a barrier device and barrier wall that can be deployed into position quickly.

Another object of the present invention is to provide a barrier device and barrier wall that is light weight, durable, and/or capable of absorbing kinetic energy from vehicular and other types of impact.

Yet another object of the present invention is to provide a barrier device and barrier wall that offers suitable protection for personnel from gunfire, shrapnel, and explosive forces.

Still another object of the present invention is to provide a barrier device and barrier wall that is easy to handle, deploy, assemble, disassemble and/or transport.

A further object of the present invention is to provide a barrier device and barrier wall that is lightweight.

A yet further object of the present invention is to provide a barrier device and barrier wall that is easy and/or cost effective to manufacture.

A still further object of the present invention is to provide a barrier device and barrier wall that can be deployed and/or assembled without the use of heavy equipment such as cranes and/or lifts.

It is also an object of the present invention to provide a barrier device and a barrier wall that is stable, durable and/or has increased strength.

Still another object of the present invention is to provide a barrier device and barrier wall that can be quickly expanded to increase the protected area.

These and other object are met by the present invention, which in one aspect can be a barrier device comprising: a base plate having a bottom surface and a top surface; a wall plate connected to and extending upward from the top surface of the first plate, the wall plate comprising a first lateral edge and a second lateral edge; and means at or near the first lateral edge for slidably receiving and engaging the second lateral edge. By designing the barrier device such that the first lateral edge can slidably engage the second lateral edge, multiple barrier devices can be linked together in a side-by-side arrangement to form a robust barrier wall without the use of heavy tools to effectuate the connection and without the use of additional component parts.

In one embodiment, the receiving means comprises a first plate and a second plate. The first and second plates will preferably comprise a substantially planar surface and be connected to the front and rear surfaces of the wall plate respectively so that at least a portion of the planar surfaces of the first and second plates extend beyond the first lateral edge of the wall plate. The planar surfaces of the first and second plates oppose one another in spaced relation, forming a space therebetween. It is this space in which an edge portion of a wall plate from a second barrier device can be inserted. In order to minimize relative movement between adjacent barrier devices in barrier wall assembly, the space formed between the first and second plates is preferable slightly greater than or substantially equal to the thickness of the wall plate.

If desired, one or more holes can be provided through each of the first and second plates in aligned fashion. In such an embodiment, corresponding holes will also be provided through the wall plate at or near its second lateral edge. Most preferably, all of the holes are located so that when two barrier devices are linked together in a side-by-side arrangement, the holes of the first and second plates of the first barrier will be aligned with the holes of the wall plate near the second lateral edge of the second barrier. A bolt or other fastener can then be inserted through the holes to further secure the linkage of the two barrier devices.

In another embodiment, the barrier device can further comprise a means positioned adjacent a front surface of the wall plate for absorbing kinetic energy from an impact event. The kinetic energy absorbing means preferably comprises an impact plate having a horizontal cross-sectional profile comprising a zigzag shape. More preferably, the impact plate comprises a plurality of planar sections connected end-to-end in an alternating angled fashion so as to form a plurality of substantially V-shaped undulations. It is further preferable that only the first and second lateral edges of the impact plate be connected to the wall plate. This allows the impact plate to deform freely during an impact event thereby absorbing some of the kinetic energy of the oncoming vehicle/debris.

In the embodiment where the receiving means comprises the first and second plates, the impact plate will preferably comprise a cutout near its lateral edge that is connected near the second lateral edge of the wall plate. The cutout is sized to accommodate the cross-section of the first plate.

Preferably, the wall plate is connected to the top surface of the base plate at a location between the mid-length and the rear edge of the base plate. In one embodiment, the wall plate is preferably positioned at least 2 feet from the front edge of the base plate. By providing adequate distance between the wall plate and the front edge of the base plate, it is ensured that the base plate extends in front of the wall plate a sufficient distance so that an oncoming vehicle's tires will ride up onto the base plate prior to the leading end of the vehicle contacting the wall plate. As a result, the vehicle's own weight will help keep the barrier device in place and prohibit the vehicle from further advancement.

It also preferred that each barrier device also comprise a means for gripping the base plate. The gripping means can be a plurality of cutouts in the base plate located at or near its perimeter or a plurality of rod-like members pivotably connected to the base plate. The weight of the barrier structure is preferably maintained at or below 450 pounds so that it can be easily carried and manually deployed by personnel. It is further preferable that all components of the barrier devise be constructed of a metal, a metal alloy or a non-brittle material.

Each barrier can also comprises an angled support structure that is connected to the rear surface of the wall plate and the top surface of the base plate. The angled support structure provides additional resistance to any impactive force that may be applied to the front surface of the wall plate. In one embodiment, the angled support structure can comprise a rectangular plate and two triangular plates. The rectangular plate can be connected to the rear surface of the wall plate and to the top surface of the base plate in an angled fashion (i.e., sloping downward from the rear surface of the wall plate to the top surface of the base plate). The triangular plates can be positioned vertically on either side of the rectangular plate and connected to the base plate, the wall plate, and the rectangular plate.

In another aspect, the invention can be a barrier wall comprising: a plurality of barrier devices, each barrier device comprising: (i) a base plate having a bottom surface and a top surface; (ii) a wall plate connected to and extending upward from the top surface of the first plate, the wall plate comprising a first lateral edge and a second lateral edge; and (iii) means at or near the first lateral edge for slidably receiving and engaging the second lateral edge. In this aspect of the invention, the barrier devices are aligned in a side-by-side arrangement so that a portion of the wall plate at or near the second lateral edge of one barrier device is slidably inserted into and engaged by the receiving means of an adjacent barrier device.

In still another aspect, the invention can be a method of creating a barrier wall comprising: a) providing first and second barrier devices each barrier device comprising: (i) a base plate having a bottom surface and a top surface; (ii) a wall plate connected to and extending upward from the top surface of the first plate, the wall plate comprising a first lateral edge and a second lateral edge; and (iii) means at or near the first lateral edge for slidably receiving and engaging the second lateral edge; b) placing the first barrier device in a desired location with the bottom surface of the base plate in contact with a support surface; c) positioning the second barrier device adjacent the first barrier device so that the second lateral edge of the second barrier device is adjacent and aligned with the first lateral edge of the first barrier device; and d) moving the first and/or second barrier devices together so that the second lateral edge of the second barrier device is slidably inserted into and engaged by the receiving means of the first barrier device.

DETAILED DESCRIPTION OF THE DRAWINGS

Figure 1:
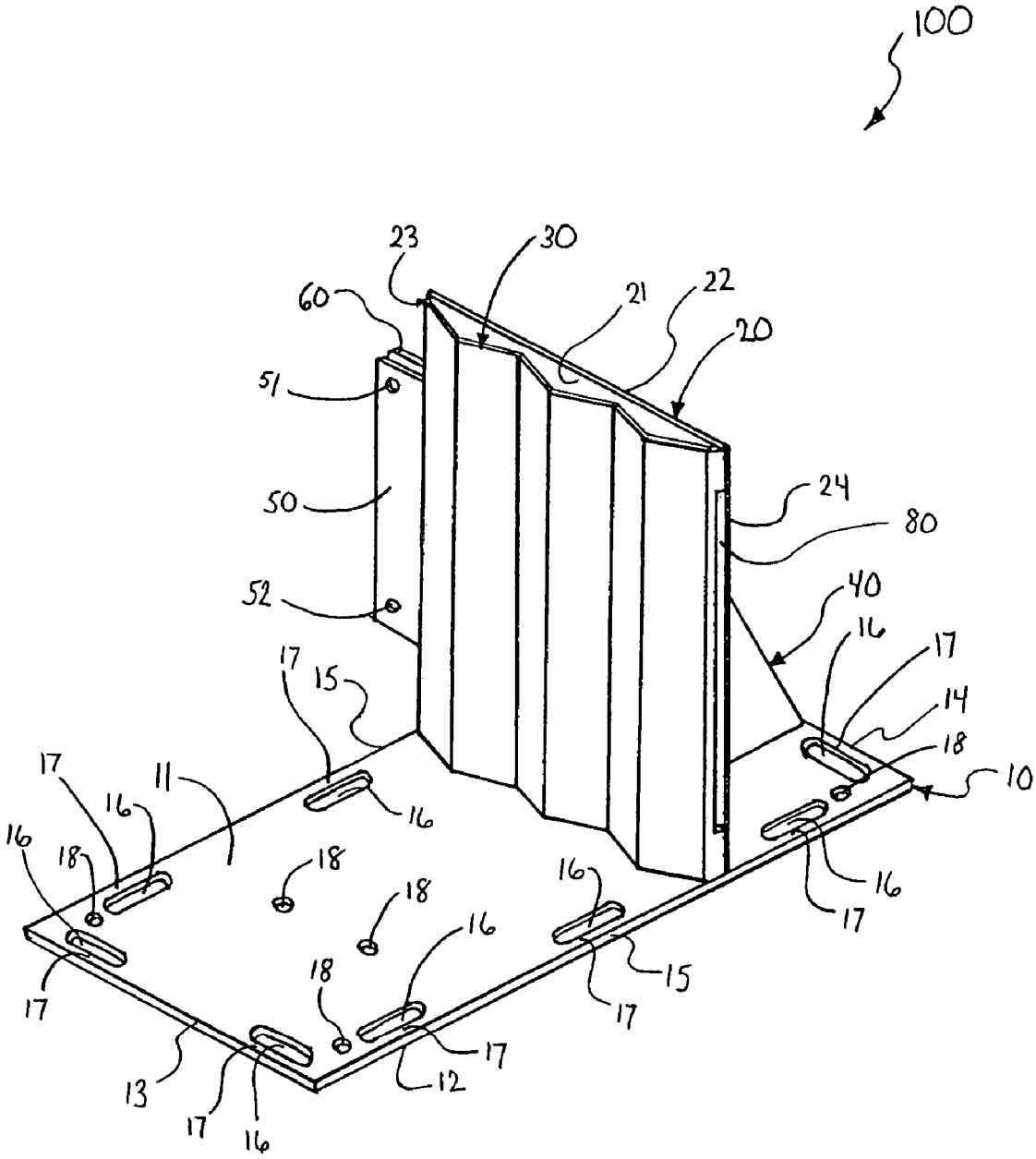
FIG. 1 is a front perspective view of a barrier device according to one embodiment of the present invention.

Referring to FIG. 1, a barrier device 100 is illustrated according to an embodiment of the present invention. The barrier device 100 can assist United States troops deployed throughout the world in dealing with the ever increasing threat of terrorism. When used properly, the barrier device 100 maintains a safe distance between troops (or a desired structure or location) and any suicide bombers either walking or driving a vehicle. The barrier device 100 can also be used by civilian industries to protect natural gas pipelines, electric power stations, nuclear power plants, etc. from the threat of attacks throughout the world.

All of the main components of the barrier device 100 are preferably constructed of steel and are welded together to form an integral structure of the highest strength. However, the other materials can be used, including, without limitation, any metal, metal alloy, or combinations thereof. Additionally, connection between parts can be achieved by whatever means desired, including welding, bolting, screwing, adhesion, etc. The barrier device 100 will last well over 20 years with practically no maintenance. Preferably, the barrier device 100 is coated with a paint or other corrosion resistant material to maintain the integrity of the materials and the connections. Moreover, the barrier device 100 can be easily converted from a rapid deployment device into a permanent barrier with the use of several small key spot welds between adjacent barrier devices and/or proper anchoring.

The barrier device 100 comprises a base plate 10, a wall pate 20, an impact plate 30, an angled support structure 40, a first connector plate 50 and a second connector plate 60. The wall plate 20 is connected to and extends upward from the top surface 11 of the base plate 10 in a substantially perpendicular manner. However, if desired, the wall plate 20 can extend upward from the base plate 10 at an angle. The impact plate 30 is positioned adjacent to and in front of the wall plate 20. As will be described in greater detail below, the impact plate 30 is connected to the front surface 21 of the wall plate 20 and is designed to absorb kinetic energy from a frontal impact event. The angled support structure 40 is connected to the rear surface 22 of the wall plate 20 and the top surface 11 of the base plate 10. The angled support structure 40 slopes downward from the rear surface 22 of the wall plate 20 to the top surface 11 of the base plate 10 and provides added structural support/integrity to the barrier device 100 during a frontal impact event.

The base plate 10, the wall plate 20, the impact plate 30, the first connector plate 50, the second connector plate 60 and the support structure 40 are formed from steel plates. In one embodiment, the base plate 10 and the wall plate 20 can be formed from ⅜ inch thick AR235 steel. The angled support structure 40 can be formed from ⅜ inch thick AR235 steel. The impact plate 30 can be formed from 3/16 inch thick AR400 steel. The first and second connector plates 50, 60 can be formed from ¼ inch thick AR200 steel. All connections between the plates 10, 20, 30, 40, 50, 60 are achieved by welding. Preferably, an integral and rigid structure is formed. While the invention is not so limited, the barrier device 100 is constructed so that armor piercing rounds can not penetrate through the wall plate 20 during a frontal assault. As a result, the wall plate 20 can also serve as a shield for personnel during firefights in addition to a vehicle barrier.

Furthermore, it is preferred that the barrier device 100 be constructed entirely of metal, metal alloys, or other non brittle materials to minimize the creation of debris resulting from an impact event. Thus, in one embodiment, the barrier device 100 is free of concrete and/or other brittle materials. The total weight of the barrier device 100 is preferably maintained at or below 500 pounds so that it can be easily carried and manually deployed by personnel. In one embodiment, the total weight of the barrier device 100 is between 350 and 400 pounds, and most preferably about 370 pounds. The barrier device 100 can be off loaded from a trailer and setup at a "tactical checkpoint" within minutes upon arriving at the site. It is simple to position and requires only the physical efforts of a few soldiers. There are no tools necessary to deploy or connect multiple barrier devices 100 together.

The base plate 10 is rectangular in shape and has a substantially planar top surface 11 and an opposing substantially planar bottom surface 12. The base plate 10 has a perimeter formed by front edge 13, rear edge 14 and side edges 15. A plurality of cut-outs 16 are formed in the base plate 10 near and about its perimeter. The cut-outs 16 form handles 17 that facilitate easy lifting, moving and placement of the barrier device 100. The base plate 10 further comprises a plurality of stake holes 18 for receiving stakes that are driven into the ground. The stake holes 18 are used to secure the barrier device 100 to the ground or other supporting surface.

Figure 2:
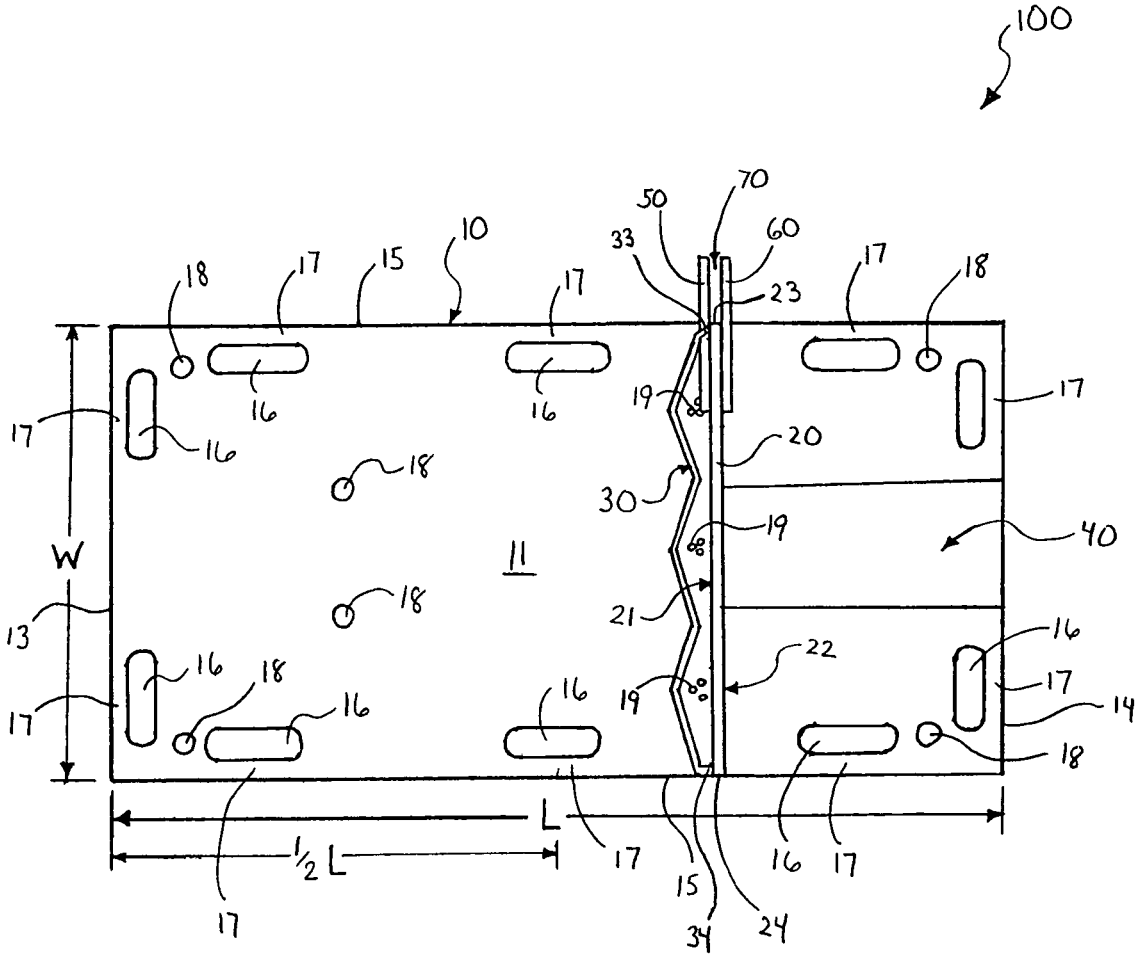
FIG. 2 is a top view of the barrier device of FIG. 1.

Referring now to FIG. 2, the base plate 10 has a length L and width W. In one embodiment, the length L of the base plate 10 is preferably between 3 and 5 feet, and more preferably about 4 feet. The width W of the base plate 10 is preferably between 1½ and 3 feet, and more preferably about 2 feet.

The wall plate 20 has a substantially vertical orientation (best seen in FIG. 5) and has a front surface 21 and a rear surface 22. The front surface 21 and the rear surface 22 are substantially planar in nature but can have curvature if desired. The wall plate 20 further includes a first lateral edge 23 and a second lateral edge 24. The first and second lateral edges 23, 24 form the sides of the wall plate 20. The wall plate 20 extends upward along the entire width W of the base plate 10 and is located closer to the rear edge 14 of the base plate 10 than to the front edge 13 of the base plate 10. In one embodiment, the wall plate 20 is located at least 2 feet from the front edge 13 of the base plate 10, more preferably between 2 and 3 feet, and most preferably about 32 inches. The height of the wall plate 20 is preferably about 33 inches.

The first and second connector plates 50, 60 are connected to the wall plate 20 at or near its first lateral edge 23. The first connector plate 50 is connected to the front surface 21 of the wall plate 20 while the second connector plate 60 is connected to the rear surface of the wall plate 20. The first and second connector plates 50, 60 are rectangular steel plates having opposing planar surfaces. In one embodiment, the first and second connector plates 50, 60 have a rectangular dimension of 8 inches by 20⅛ inches. The invention, however, is in no way limited to any specific dimensions.

The connector plates 50, 60 are attached to the wall plate 20 via welding, bolting, riveting or any other connection means. The connector plates 50, 60 are connected to the front and rear surfaces 21, 22 of the wall plate 20 respectively so that at least a portion of the connector plates 50, 60 extend laterally beyond the first lateral edge 23 of the wall plate 20 in an opposing manner. In other words, at least a portion of the connector plates 50, 60 protrude from the left side of the wall plate 20 and, thus, the barrier device 100. In one embodiment, the connector plates 50, 60 extend beyond the first lateral edge 23 of the wall plate by about 4 inches.

The inwardly facing planar surfaces of the connector plates 50, 60 oppose one another in a spaced relation, thereby forming a space/channel 70 therebetween. The width of the space/channel 70 (which is left to right in FIG. 2) that is formed between the connector plates 50, 60 is preferably equal to or slightly greater than the thickness of the wall plate 20. As a result, the second lateral edge 24 of a second barrier device 100 can be slidably inserted into the space/channel 70 with relative ease. The exact width of the space 70 for any given barrier device 100 will be dictated by the thickness of the wall plate 20 desired for the barrier wall to be created.

As will be described in detail below, the connector plates 50, 60 of the barrier device 100 are used to slidably receive and engage a portion of the wall plate of an adjacent barrier device when forming a barrier wall. The invention, however, is not limited to the use of plates 50, 60 to perform this function. For example, rods or other members can be used in place of the connector plates 50, 60 if desired. In another embodiment, a plurality of male protrusions can protrude laterally from the first lateral edge of the wall plate and fit into corresponding female receptors located in the second lateral edge of the wall plate of an adjacent barrier device.

A plurality of drain holes 19 are also provided in the base plate 10 between the wall plate 20 and the impact plate 30. The drain holes 19 provide a means by which rain water that enters the space between the wall plate 20 and impact plate 30 can escape. This helps reduce corrosion of the structure that may result from stagnant water.

Figure 3:
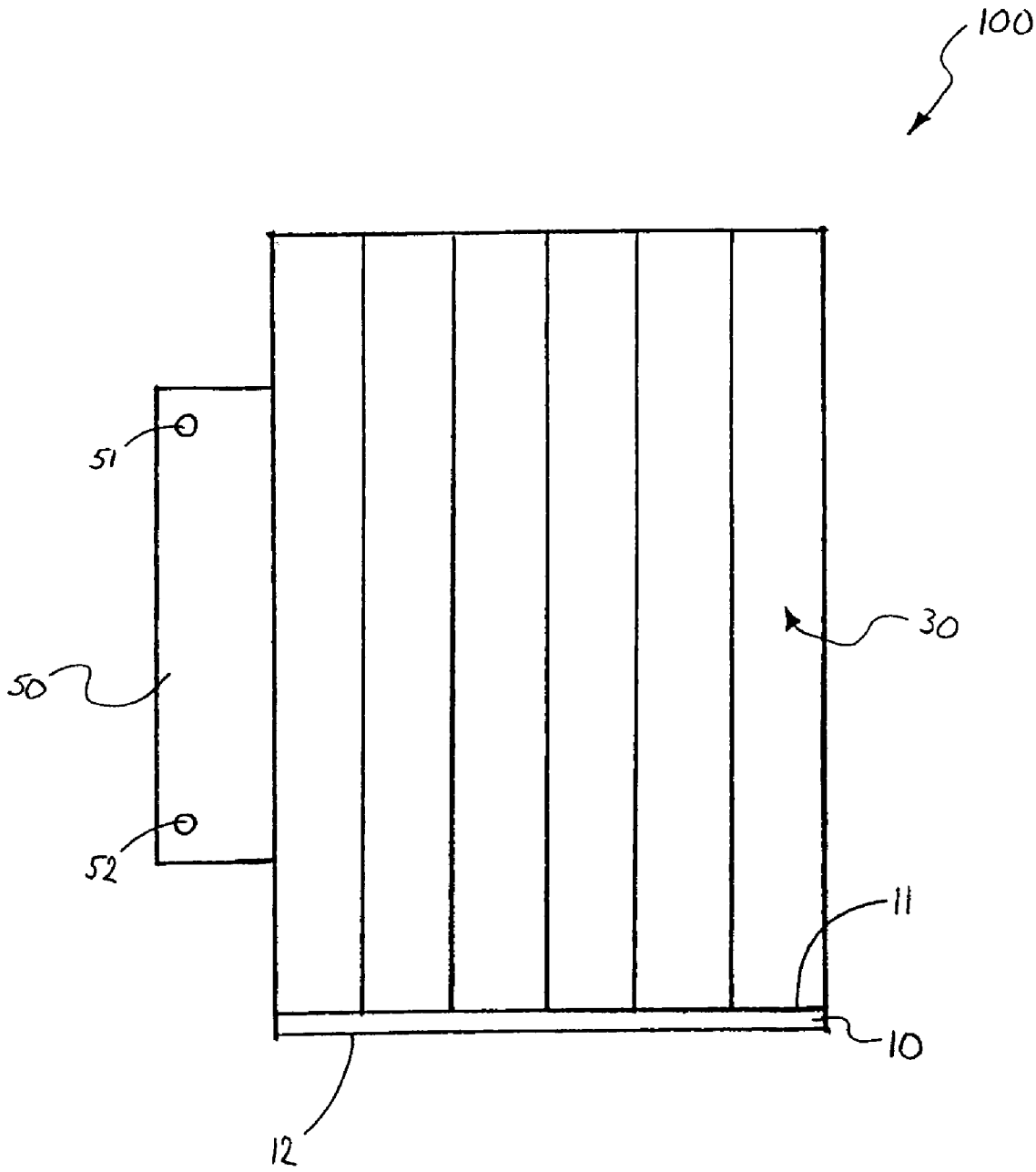
FIG. 3 is a front view of the barrier device of FIG. 1.
Figure 4:
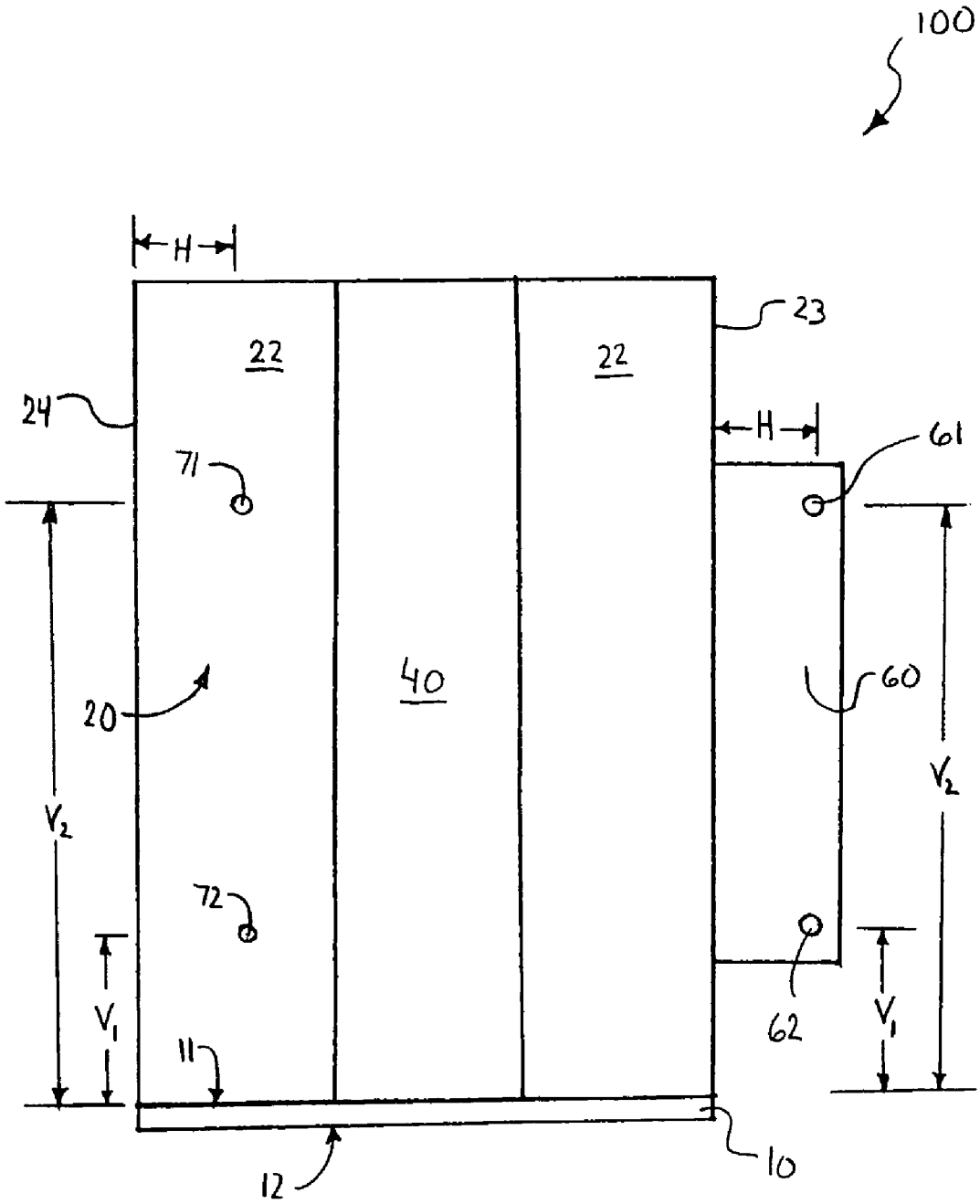
FIG. 4 is a rear view of the barrier device of FIG. 1.

Referring now to FIGS. 3 and 4 concurrently, the first and second connector plates 50, 60 comprise corresponding sets of bolt holes 51, 61 and 52, 62 respectively. The bolt holes 51, 61 are aligned with one another so that a linear member, such as bolt, can be extended therethrough. Similarly, bolt holes 52, 62 are aligned with one another so that a bolt can be extended therethrough. The bolt holes 51, 61, 52, 62 are located a horizontal distance H from the first lateral edge 23 of the wall plate 20. The bolt holes 52, 62 are located a vertical distance $V_1$ from the top surface 11 of the base plate 10. Similarly, the bolt holes 51, 61 are located a vertical distance $V_2$ from the top surface 11 of the base plate 10.

Referring solely now to FIG. 4, the wall plate 20 further comprises bolt holes 71, 72 at or near its second lateral edge 24. The bolt holes 71, 72 are positioned on the wall plate 20 so that they are located at the same horizontal distance H away from the second lateral edge 24 as the bolt holes 51, 61, 52, 62 are from the first lateral edge 23. The bolt hole 72 is positioned on the wall plate 20 so that it is located at the same vertical distance $V_1$ away from the top surface 11 of the base plate 10 as the bolt holes 52, 62. Similarly, the bolt hole 71 is positioned on the wall plate 20 so that it is located at the same vertical distance $V_2$ away from the top surface 11 of the base plate 10 as the bolt holes 51, 61.

Figure 5:
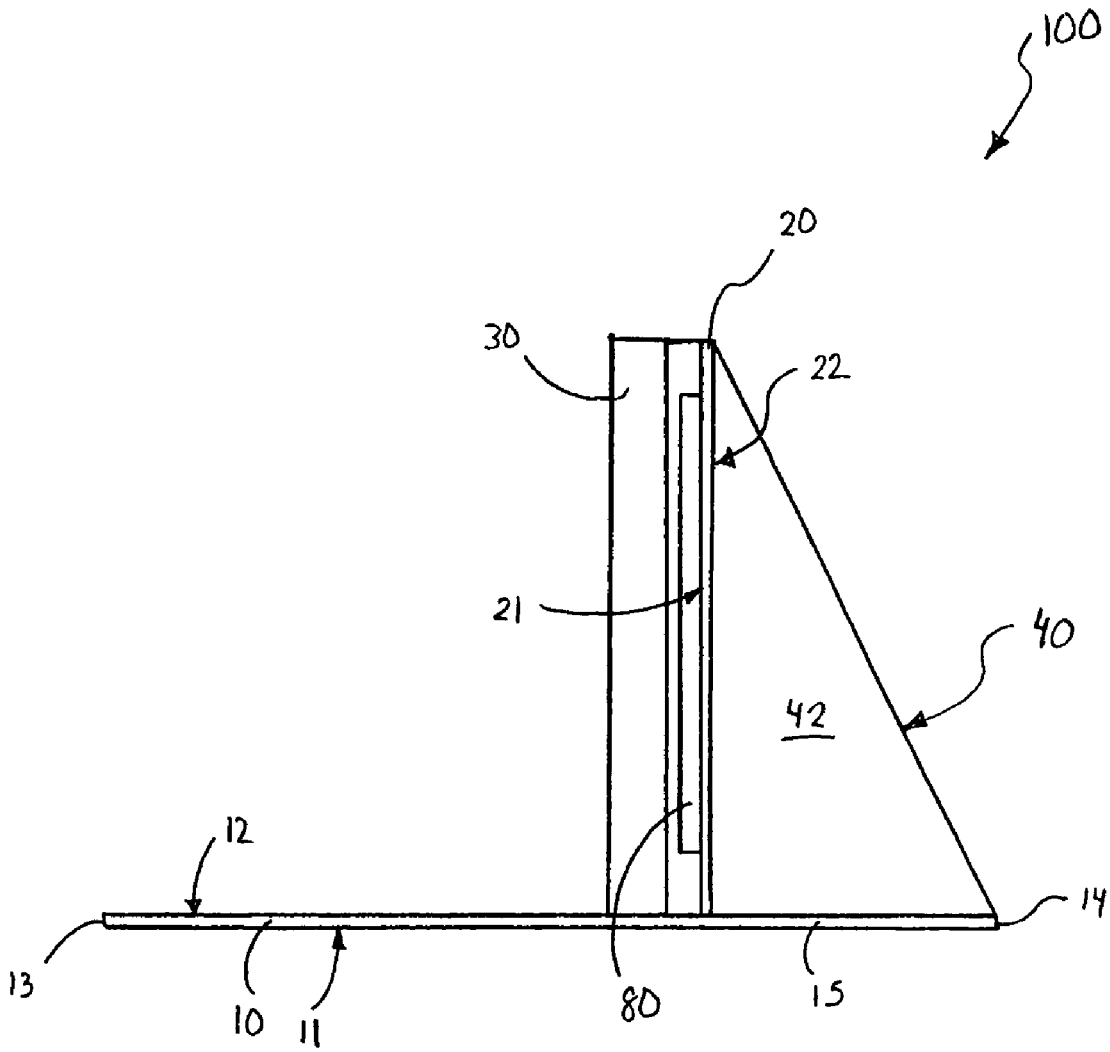
FIG. 5 is a right side view of the barrier device of FIG. 1.
Figure 6:
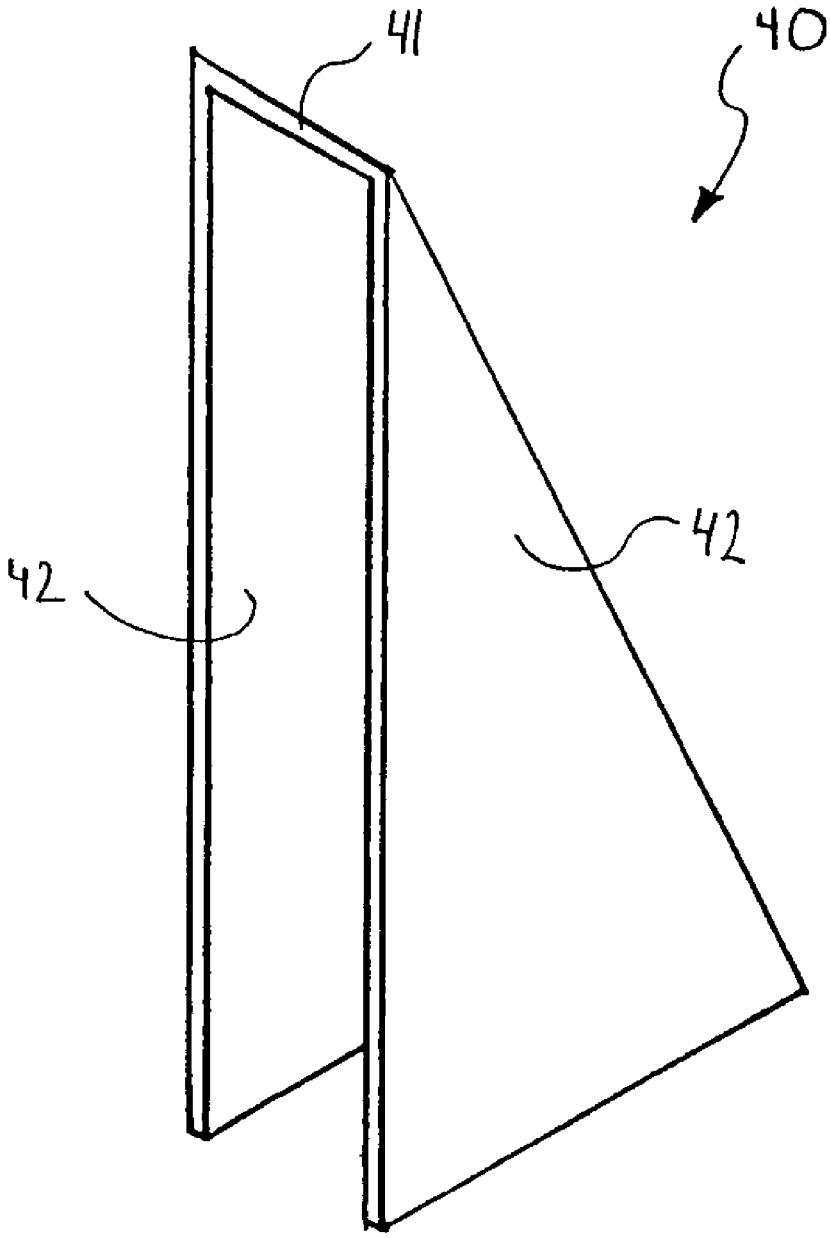
FIG. 6 is a perspective view of an angled support structure according to an embodiment of the present invention removed from the barrier device of FIG. 1.

Referring now to FIGS. 5 and 6 concurrently, the barrier device 100 comprises an angled support structure 40. The angled support structure 40 comprises a rectangular plate 41 and two triangular plates 42. The angled support structure 40 can be created by bending a single plate of steel to achieve the desired configuration. Alternatively, the plates 41, 42 can be pre-cut to size and shape and welded together to form the unitary structure 40 illustrated in FIG. 6.

The angled support structure 40 is connected to the barrier device 100 so that the rectangular plate 41 slopes downward from the rear surface 22 of the wall plate 20 to the top surface 11 of the base plate 10. The triangular plates 41 are vertically oriented and are also connected to the rear surface 22 of the wall plate 20 and the top surface 11 of the base plate 10. The connections can be achieved by welding, riveting, bolting or the like. The angled support structure 40 adds structural support/integrity to the barrier device 100 during a frontal impact event.

Figure 7A:
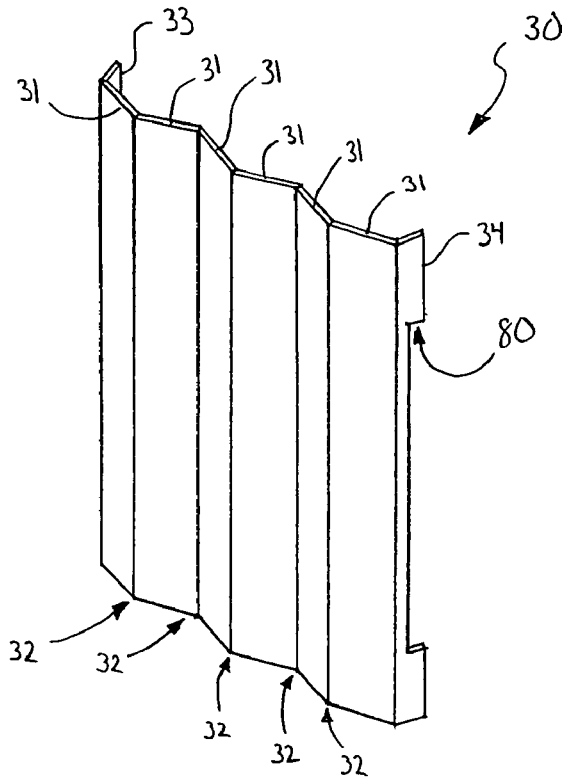
FIG. 7A is a perspective view of an impact plate according to an embodiment of the present invention removed from the barrier device of FIG. 1.
Figure 7B:
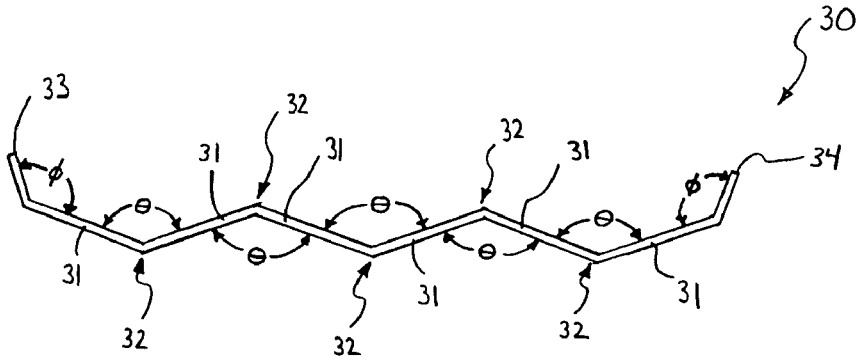
FIG. 7B is a top view of the impact plate of FIG. 7A.

Referring now to FIGS. 7A and 7B, the impact plate 30 will be described in detail. The impact plate 30 can be formed from a single piece of steel by bending the steel to the desired shape. Alternatively, separate steel plates can be connected together to form the impact plate 30. The impact plate 30 comprises a plurality of planar sections 31. The planar sections 31 are connected at alternating angles to form a plurality of generally V-shaped undulations 32. As can be seen in FIG. 7B, the impact plate 30 comprises a zigzag horizontal cross-sectional profile. In one embodiment the planar sections 31 are connected at angle θ that is about 140°. The angle ϕ is 130° in one embodiment. However, other angles can be used as desired.

The impact plate 30 further comprises a first lateral edge 33 and as second lateral edge 34. A cutout 80 is provided in the impact plate 30 near the second lateral edge 34. The cutout 80 is provided on the impact plate 30 so that the first connector plate 50 of an adjacent barrier device 100 can freely pass through the cutout 80. This will be discussed in greater detail with respect to FIGS. 8 and 9. The cutout 80 is preferably sized so as to be larger than the cross-sectional profile of the first connecting plate 50. More preferably, the cutout 80 is sized to correspond to the size and shape of the cross-sectional profile of the first connecting plate 50. In one embodiment, the cutout is centered on the height of the impact plate 30 and approximately ½× inch wide and 21 inches high. In one embodiment, the total height and width of the impact plate 30 can be about 33 and 24 inches respectively.

Referring back to FIGS. 2 and 5 concurrently, the impact plate 30 is connected to the barrier device 100 in a substantially vertical orientation. The impact plate 30 is positioned directly in front of the wall plate 20 in an adjacent manner. The impact plate 30 is connected to the wall plate 20 only at its first and second lateral edges 33, 34. More specifically, the first and second lateral edges 33, 34 of the impact plate are connected to the wall plate 20 at or near the first and second lateral edges 23, 24 of the wall plate 20 respectively. The apexes formed by the undulations of the impact plate 30 are not connected to the wall plate 20. Similarly, the bottom edge of the impact plate 30 is not connected/secured to the base plate 10. As a result of leaving the apexes of the impact plate 30 spaced from and free from connection to the wall plate 20, the impact plate 30 can more freely deform during an impact event, thereby more effectively absorbing the kinetic energy from an oncoming projectile or vehicle.

While the impact plate 30 is illustrated as a plate having V-shaped undulations, other profiles could be used. For example, the undulations could be wave like in one embodiment. In another embodiment, the impact plate could be simply bowed so that its front surface is convex. In still another embodiment, other materials could be used to act as a kinetic energy absorber, such as deformable, collapsible and/or resilient materials.

Figure 8:
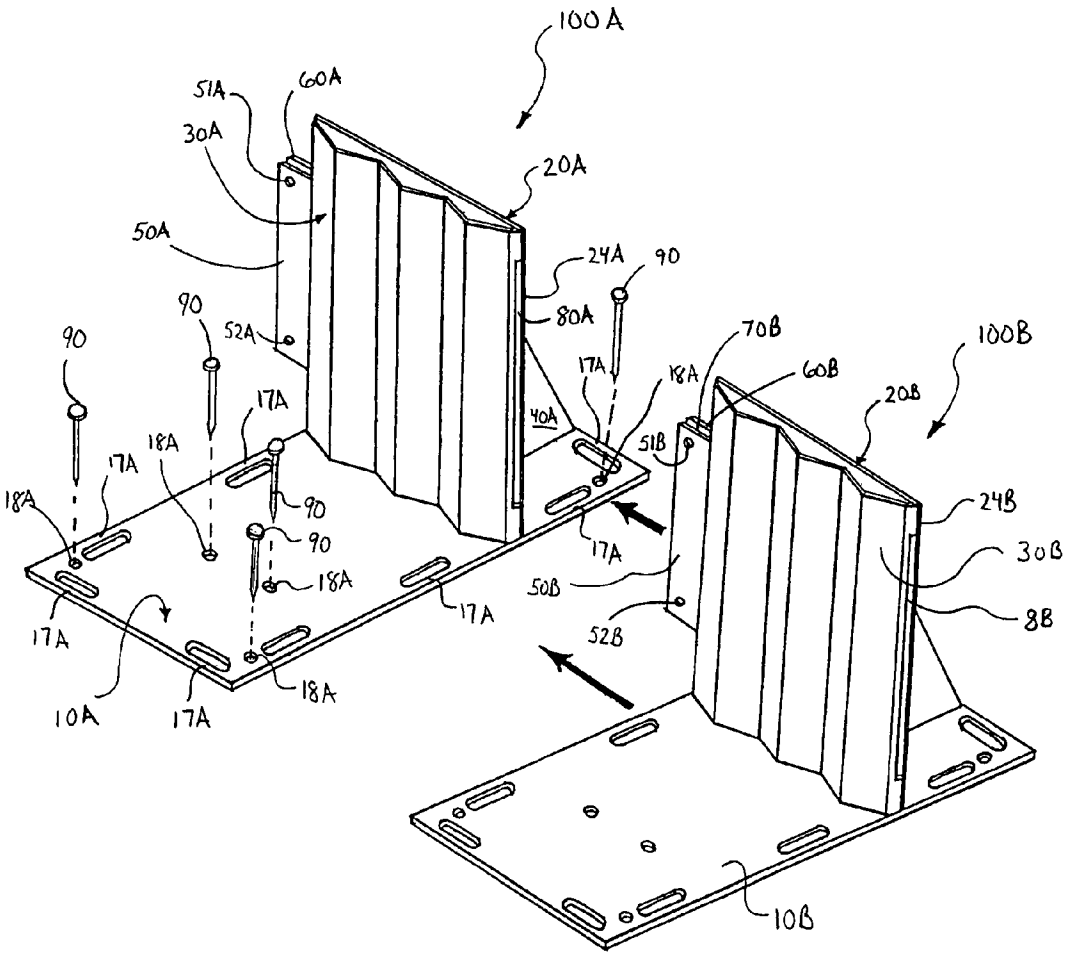
FIG. 8 is a perspective view of two barrier devices of FIG. 1 in a side-by-side arrangement to facilitate slidable linking to form a barrier wall according to one embodiment of the present invention.
Figure 9:
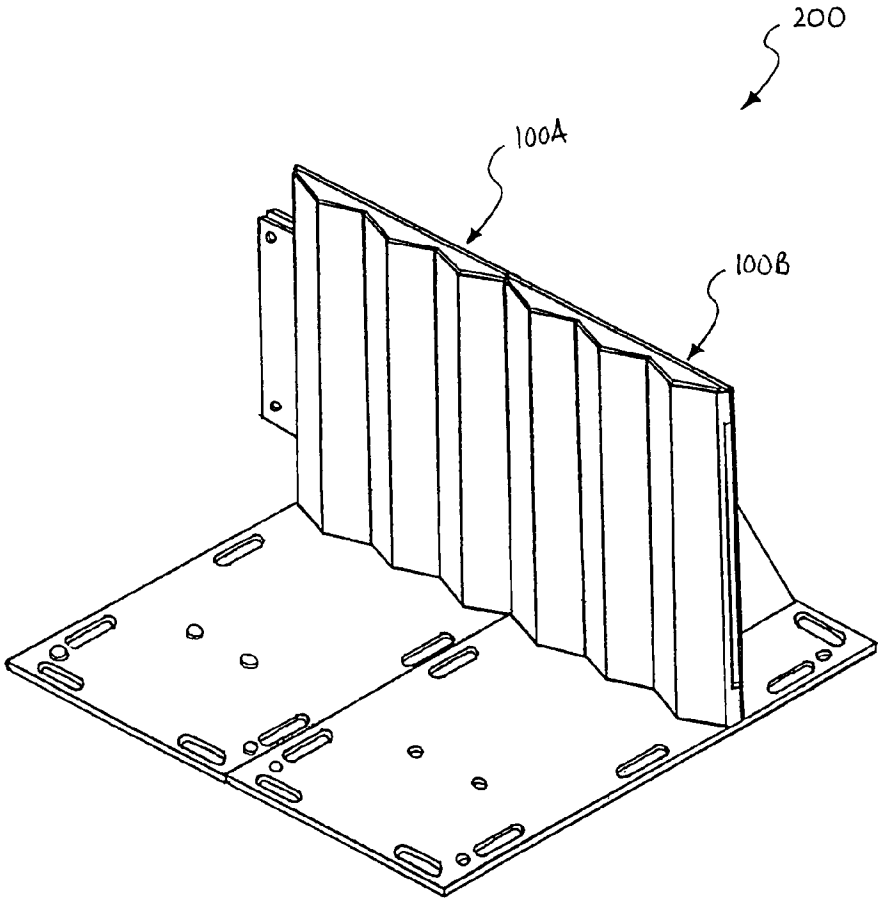
FIG. 9 is a perspective view of two barrier devices linked together to form a barrier wall according to one embodiment of the present invention.

Referring now to FIGS. 8 and 9, the use of two barrier devices 100A and 100B to rapidly create a barrier wall 200 will be described. The barrier device 100A and 100B are identical to the barrier device 100 discussed above with respect to FIGS. 1-7. For clarity of explanation, alphabetical suffixes will be added to the numerical identifiers with the understanding that like numbers indicate the like parts described above.

Referring first to FIG. 8, a first barrier 100A is carried to a desired location. Because of its lightweight construction, the barrier device 100A can be easily picked up and deployed into position by four people. The barrier device 100A is carried by its handles 17. Once in the desired location, the barrier device 100A is lowered so that the bottom surface 12 of the base plate 10 rests atop the ground (or other support surface). Once the first barrier device 100A is in position, stakes 90 are inserted through the stake holes 18 and hammered into the ground. The stakes 90 help to further stabilize the barrier device 100A during construction of the barrier wall and during a subsequent impact event.

Once the stakes 90 are in place, a second barrier 100B is provided for side-by-side positioning with the first barrier device 100A as illustrated in FIG. 8. The second barrier device 100B is then moved in a horizontal direction toward the first barrier device 100A. As the barrier devices 100A, 100B get closer together, the second lateral edge 24A (and a portion of the wall plate 20A) slides into the space/channel 70B formed between the first and second connecting plates 50B, 60B of the second barrier device 100B. As a result, the portion of the wall plate 20A of the first barrier device 100A near the second lateral edge 24A is positioned/sandwiched between the first and second connecting plates SOB, 60B of the second barrier device 100B. Contemporaneously, the first connector plate 50B of the second barrier device 100B slides through the cutout 80A in the impact plate 30A of the first barrier device 100A. This sliding motion continues until the barrier devices 100A, 100B contact one another as illustrated in FIG. 9 to form a barrier wall 200. Thus, even without further fastening, the barrier device 100A, 100B are engaged in such a manner that they can not move independent of one another in either the front or rear directions.

Referring now to FIG. 9, the first and second barrier devices 100A, 100B are in a fully linked position so as to form a barrier wall 200. While not visible, once the barriers 100A, 100B are in this position, the bolt holes 51B, 61B of the second barrier device 100B are aligned with the bolt hole 71A of the first barrier device 100A. Similarly, the bolt holes 52B, 62B of the second barrier device 100B are aligned with the bolt hole 72A of the first barrier device 10A. A bolt is then inserted through each of the two sets of aligned bolt holes to further secure the first and second barrier devices 100A, 100B together in a robust manner. The bolts can threadily engage nuts aligned with and welded to the opposite side of the bolt holes 51B, 52B. Alternatively, the inside surfaces of one or more of the bolt holes can be threaded.

There is no limit on the number of barrier devices 100 that be connected together to form a rigid barrier wall structure 200.

Referring now to FIGS. 10-14, a barrier device 300 is illustrated according to an alternative embodiment of the present invention. The barrier device 300 comprises a base plate 310, a wall plate 320, an impact plate 330 and angled support structures 340. The structural components (and their functioning) of the barrier device 300 are substantially similar to those discussed above with respect to the barrier device 100. Therefore, in order to avoid redundancy, only those design aspects of the barrier device 300 that substantially differ from the barrier device 100 will be discussed.

Figure 10:
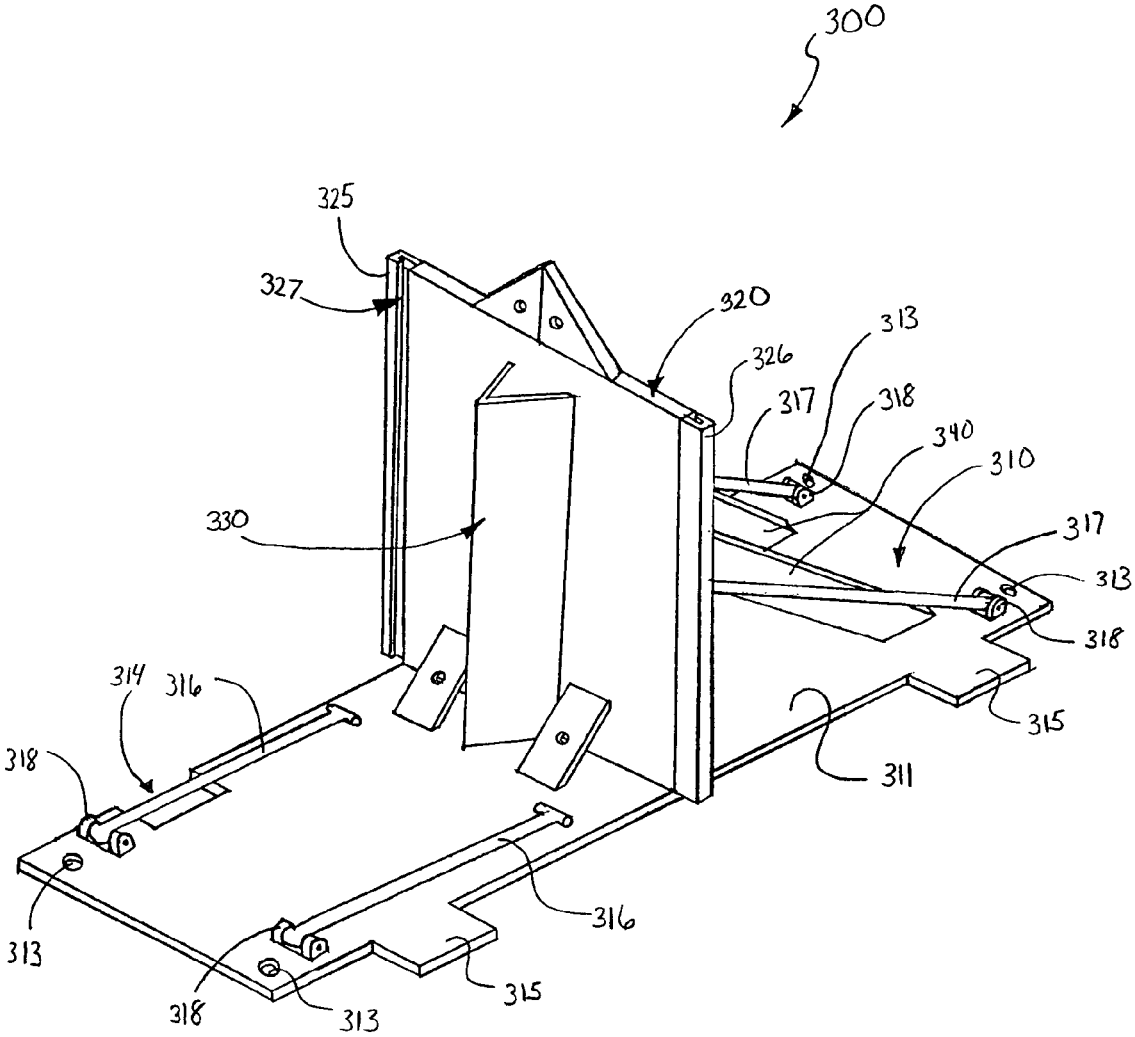
FIG. 10 is a front perspective view of a barrier device according to a second embodiment of the present invention.
Figure 11:
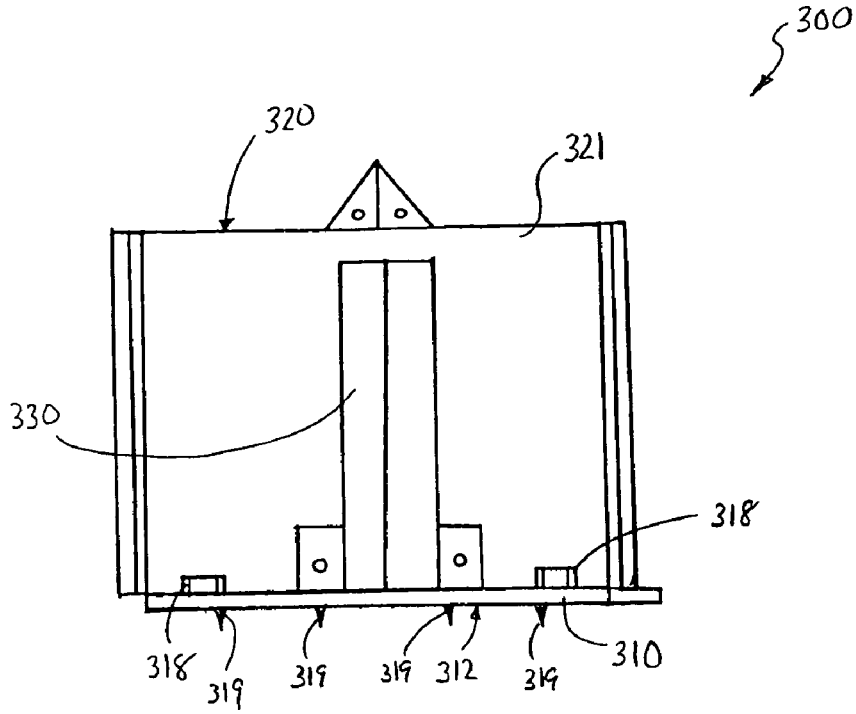
FIG. 11 is a front view of the barrier device of FIG. 10.

Referring to FIG. 10, the barrier device 300 comprises rear carrying handles 316 and front carrying handles 317 which assist troops in deploying the barrier device 300 in the field without the need of any heavy equipment. The front and rear carrying handles 316, 317 are pivotably connected to the top surface 311 of the base plate 310 via pin and plate assemblies 318. Through the use of the handles 316, 317, the barrier device 300 can be just as quickly disassembled and transported to a new location for redeployment.

The front carrying handles 316, 317 can be pivoted between a resting position where the carrying handles 317 lie flat on the base plate 310 to a carrying position where the handles extend upwardly at an angle from the base plate 310.

The base plate 310 further comprises cutouts 314 in a side edge of the perimeter of the base plate 310. Extension plates 315 extend from the opposite side edge of the base plate 310 and correspond to the cutouts 314 in size, shape, and placement.

Figure 12:
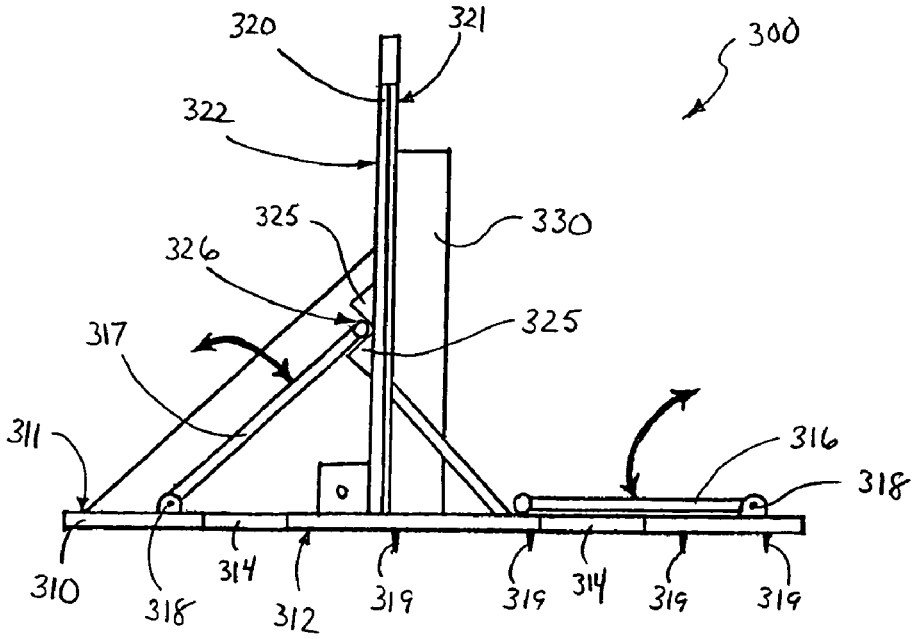
FIG. 12 is a left side view of the barrier device of FIG. 10.

Referring to FIG. 12, the rear carrying handles 317 are designed so that they provide additional structural support to the wall plate 320 of the barrier device 300 when in the resting position. This is achieved by providing two pair of triangular structures 325 on the rear surface 322 of the wall plate 320. Each pair of the triangular structures 325 forms an indentation 326 in which the fore-end of the rear carrying handles 317 will rest, thereby forming additional angled support from the base plate 20 to the wall plate 21.

A plurality of spikes 319 preferably extend from the bottom surface 312 of the base plate 310. The spikes 012 pierce the ground when the barrier device 300 is placed on the ground, thereby assisting with stabilization. Further stabilization can be achieved by extending stakes or other engagement means through the holes 313 (FIG. 10).

Referring back to FIG. 10, the wall plate 310 further comprises first and second groove interlock structures 325, 326 formed into the first and second lateral edges of the wall plate 320 respectively. The first interlock structure 325 is designed to slidably engage the second interlock structure 326 of an adjacent barrier structure 300 (as illustrated in FIGS. 13 and 14).

The first and second interlock structures 325, 326 are substantially J-shaped interlocks. More specifically, the first interlock structure 325 has a J-shaped horizontal cross-sectional profile that forms a vertically oriented channel 327. The second interlock structure 326 also has a J-shaped horizontal cross-sectional profile. However, the horizontal cross-sectional profile of the second interlock structure 326 is a mirror image of the horizontal cross-sectional profile of the first interlock structure 325. As a result, the second interlock structure 326 can be slidably inserted downwardly into the vertical channel 327 of the first interlock structure 325 to facilitate a mating relationship (shown in FIG. 14).

While the first and second interlock structures 325, 326 are illustrated as being substantially J-shaped, other configurations can be used. For example, a variety of mating cross-sectional shapes, such as generally C-shaped, generally U-shaped, dove-tail, generally L-shaped, or any other type of slidable mating configuration can be used. There is no limitation on the variety and number of cross-sectional shapes that can be used within the scope of the invention. Male and female interlocks can also be used as discussed above.

Figure 13:
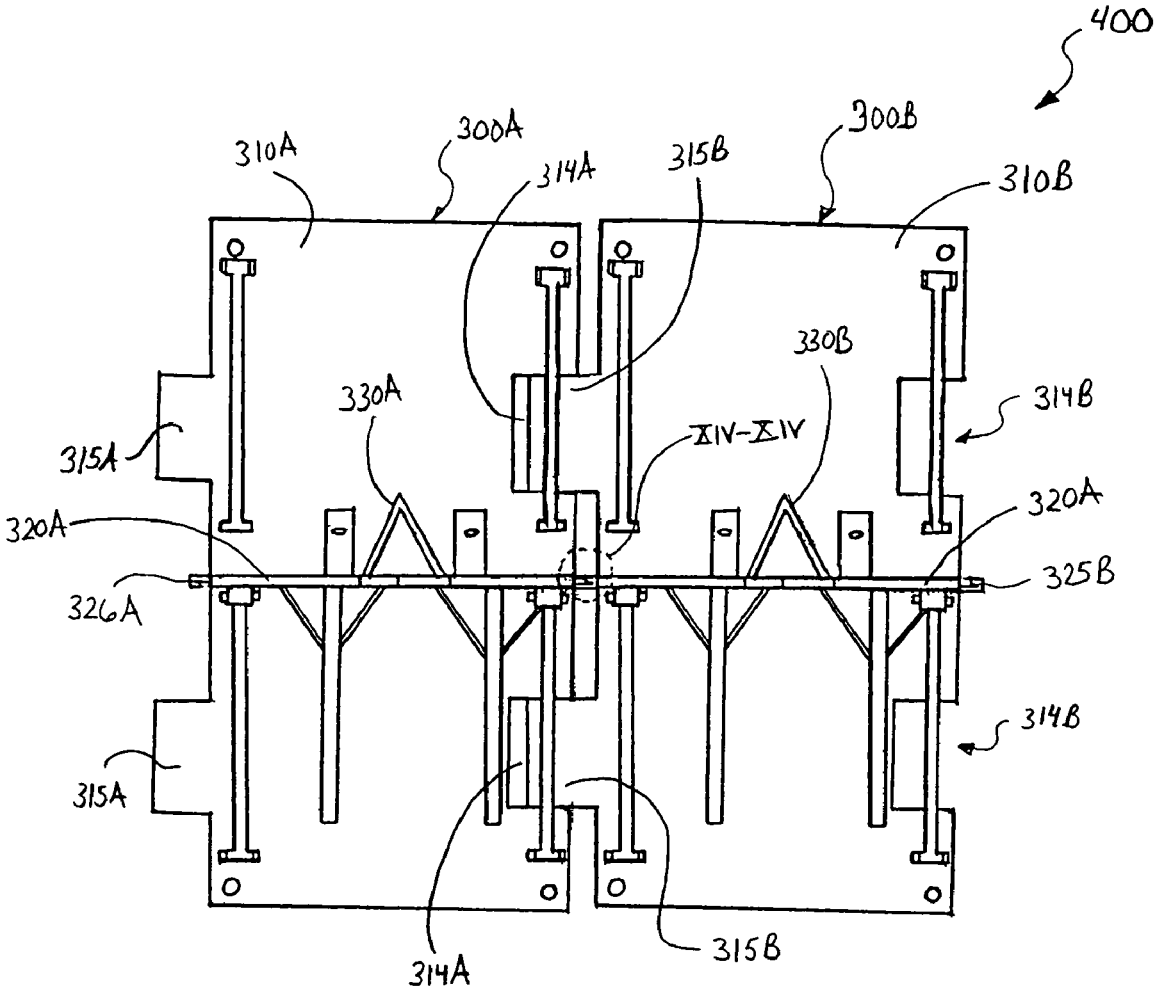
FIG. 13 is a top view of two barrier devices of FIG. 10 linked together to form a barrier wall according to a second embodiment of the present invention.
Figure 14:
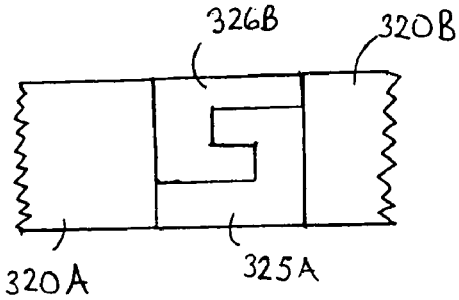
FIG. 14 is an enlarged view of the area XIV-XIV of FIG. 13.

Referring now to FIGS. 13 and 14, the interlock structures 325, 326 allow a plurality of barrier devices 300A, 300B to be linked together in a side-by-side relation to form a barrier wall 400. More specifically, the first interlock structure 325A of a first barrier device 300A can be slid into the second interlock structure 326B of a second barrier device 300B to form a mating engagement.

When the barrier devices 300A, 300B are fully engaged, the extension plates 315B of the second barrier device 300B will slide into and engage the cutouts 314A of the first barrier device 300A. By interlocking the extension plates 315B into the corresponding cutouts 314A, an enormous resistance to shear forces is provided.

For all embodiments of the invention, the recommended deployment configuration during a tactical checkpoint is a "split V formation" beginning at the actual checkpoint and working outward into a larger V. The troops and vehicles, of course will be secured within and behind the barrier wall assuring them of the maximum protection. The "kill zone" will be a designated area in front of the barrier wall (from either angle). The troops and vehicles should be no closer than 50 feet to the actual barrier for maximum protection.

While the invention has been described and illustrated in sufficient detail that those skilled in this art can readily make and use it, various alternatives, modifications, and improvements should become readily apparent without departing from the spirit and scope of the invention.

What is claimed is:

1. A barrier device for prohibiting people, vehicles and other machinery from entering a protected space, the barrier device comprising:

a metal base plate structure having a bottom surface and a top surface, the base plate structure further having a front edge and a rear edge defining a length;

a metal wall plate structure connected to and extending upward from the top surface of the base plate structure, the wall plate structure connected to the top surface of the base plate structure at a location between a mid-point of the length and the rear edge to permanently fix the wall plate structure in a perpendicular position relative to the base plate structure, the wall plate structure including a first side facing the front edge and a second side facing the rear edge;

a support structure having at least one triangular metal plate disposed on the second side of the wall plate structure;

a metal impact plate structure disposed on the first side of the wall plate structure, the impact plate structure having a plurality of planar sections oriented perpendicularly to the base plate, the planar sections extending from the wall plate structure and connected to one another at an angle to form at least one V-shape pointing toward the front edge;

at least one hole extending through the base plate structure, the at least one hole located between the wall plate structure and the front edge of the base plate structure;

an anchor member adapted to extend though the at least one hole and into a surface on which the barrier device is placed; and the front edge being a distance from the first side so that when a vehicle impacts the first side, tires of the vehicle will be located atop the base plate structure.

2. The barrier device of claim 1 wherein the wall plate structure is constructed so as to be substantially impenetrable to armor piercing rounds.

3. The barrier device of claim 1, wherein the barrier device is substantially free of concrete and other brittle materials.

4. The barrier device of claim 1, wherein the support structure further includes a rectangular plate and a second triangular plate, the rectangular plate connected to the second surface of the wall plate structure and sloping downward and connected to the top surface of the base plate structure, second triangular plate connected to the base plate structure, the wall plate structure, and the rectangular plate.

5. The barrier device of claim 1 wherein the base plate structure has a width, the wall plate structure extending across the entire width of the base plate structure.

6. The barrier device of claim 1 wherein the base plate structure and the wall plate structure are substantially rectangular in shape.

7. The barrier device of claim 1 further comprising at least one handle.

8. The barrier device of claim 1 further comprising means for securing the barrier device to an adjacent barrier device.

9. The barrier device of claim 1 further comprising a first connector plate effective to be connected to an adjacent barrier device.

10. The barrier device of claim 1, wherein the barrier device is constructed entirely of metal or a metal alloy.

11. The barrier device of claim 1 having a total weight of less than 500 pounds.

12. The barrier device of claim 1 wherein, the impact plate is shaped so as to define a space between the wall plate and portions of the impact plate, the impact plate being effective to absorb kinetic energy from an impact to the barrier device.

13. The barrier device of claim 1 wherein the wall plate structure is connected to the base plate structure at least 2 feet from the front edge of the base plate structure.

14. A barrier wall comprising:

a plurality of the barrier devices as defined in claim 1.

15. The barrier wall of claim 14 wherein the barrier devices are secure adjacent to one another using a connector.

* * * * *